United States Patent [19]

Bader et al.

[11] 4,322,653

[45] Mar. 30, 1982

[54] APPARATUS INCLUDING AN X-RAY TUBE WITH SHIELDING ELECTRODES

[75] Inventors: Dietrich Bader; Sieghard Reiprich, both of Berlin, Fed. Rep. of Germany

[73] Assignee: Licentia Patent-Verwaltungs-G.m.b.H., Frankfurt am Main, Fed. Rep. of Germany

[21] Appl. No.: 81,262

[22] Filed: Oct. 2, 1979

[30] Foreign Application Priority Data

Dec. 23, 1978 [DE] Fed. Rep. of Germany ..... 2855905

[51] Int. Cl.[3] ..... H01J 35/04; H01J 35/16

[52] U.S. Cl. ..... 313/55; 313/240

[58] Field of Search ..... 313/55, 240, 219

[56] References Cited

U.S. PATENT DOCUMENTS

| | | | |
|---|---|---|---|
| 1,684,263 | 11/1928 | Coolidge | 313/55 |
| 1,824,755 | 9/1931 | Bouwers | 313/55 X |
| 1,936,424 | 11/1933 | Coolidge | 313/55 X |
| 2,148,000 | 2/1939 | Verhoeff | 313/55 X |
| 4,126,803 | 11/1978 | Bader et al. | 313/55 |

*Primary Examiner*—Palmer C. Demeo

*Attorney, Agent, or Firm*—Spencer & Kaye

[57] ABSTRACT

The X-ray apparatus of the present invention comprises a metal cylindrical wall member having a longitudinal axis and opposite open ends. A pair of end members is positioned within the open ends of the wall member, at least one of the end members being an annular ceramic member having a central aperture therein and being sealed at its outer periphery to the wall member. An anode and a cathode are located within the wall member and high voltage leads are connected to the anode and cathode, at least one of these leads passing through the aperture in the ceramic member in a vacuum-tight manner to form a vacuum-tight envelope comprising the wall and end members. At least one connecting member is releasably attached to an end of the wall member adjacent the annular ceramic member thereby providing an axial releasable electrical connection with a high voltage lead. The outer face of the ceramic member is rotationally symmetrical with respect to the longitudinal axis of the wall member and forms an angle not greater than 45° with a plane perpendicular to the longitudinal axis. At least one shielding electrode is disposed within the envelope to prevent impingement of charged particles on the annular ceramic member.

5 Claims, 4 Drawing Figures

APPARATUS INCLUDING AN X-RAY TUBE WITH SHIELDING ELECTRODES

BACKGROUND OF THE INVENTION

The present invention relates to an improved X-ray tube apparatus having an evacuated cylindrical metal envelope, anode and cathode electrodes and high voltage leads for the electrodes which are disposed at the frontal or end surfaces of the X-ray tube. In particular, the invention relates to an X-ray tube of the type described in which the effects of secondary electron emission are minimized by providing shielding electrodes.

In U.S. Pat. No. 4,126,803, granted Nov. 21, 1978 and assigned to the same assignee as the present invention, there is described an X-ray tube of the type having a sealed cylindrical vacuum envelope with the high voltage leads for the anode and cathode extending through the end surfaces of the envelope. The envelope includes a metal cylindrical wall member which is sealed in a vacuum-tight manner at both ends by respective end members with at least one of the end members being an annular ceramic member whose outer periphery is fastened to the cylindrical member in a vacuum-tight manner and through whose central opening passes one of the high voltage leads, and possibly other required leads, in a vacuum-tight manner, so that the insulating path between the associated high voltage lead and the cylindrical member is predominantly in a radial direction. Preferably the outer surface of the annular ceramic member forms an angle with a plane perpendicular to the longitudinal axis of the tube which is equal to or less than 45°, and in particular equal to or less than 30°.

U.S. Pat. No. 4,126,803 is incorporated herein by reference and forms a part of the present specification.

It is an object of the present invention to provide an apparatus including an X-ray tube which is of a compact and space saving design and has improved high voltage stability.

SUMMARY OF THE INVENTION

The X-ray apparatus of the present invention comprises a metal cylindrical wall member having a longitudinal axis and opposite open ends. A pair of end members is positioned within the open ends of the wall member, at least one of the end members being an annular ceramic member having a central aperture therein and being sealed at its outer periphery to the wall member. An anode and a cathode are located within the wall member and high voltage leads are connected to the anode and cathode, at least one of these leads passing through the aperture in the ceramic member in a vacuum-tight manner to form a vacuum-tight envelope comprising the wall and end members. At least one connecting member is releasably attached to an end of the wall member adjacent the annular ceramic member thereby providing an axial releasable electrical connection with a high voltage lead. The outer face of the ceramic member is rotationally symmetrical with respect to the longitudinal axis of the wall member and forms an angle not greater than 45° with a plane perpendicular to the longitudinal axis. At least one shielding electrode is disposed within the envelope to prevent impingement of charged particles on the annular ceramic member.

DETAILED DESCRIPTION OF THE PREFERRED EMBODIMENTS

Figure 1:
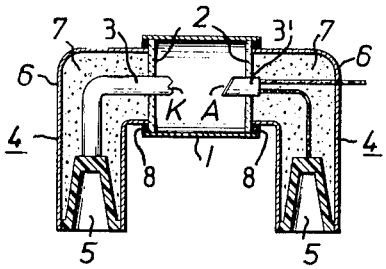
FIG. 1 PRIOR ART
FIG. 1 is a schematic sectional view showing a prior art X-ray apparatus.
Figure 3:
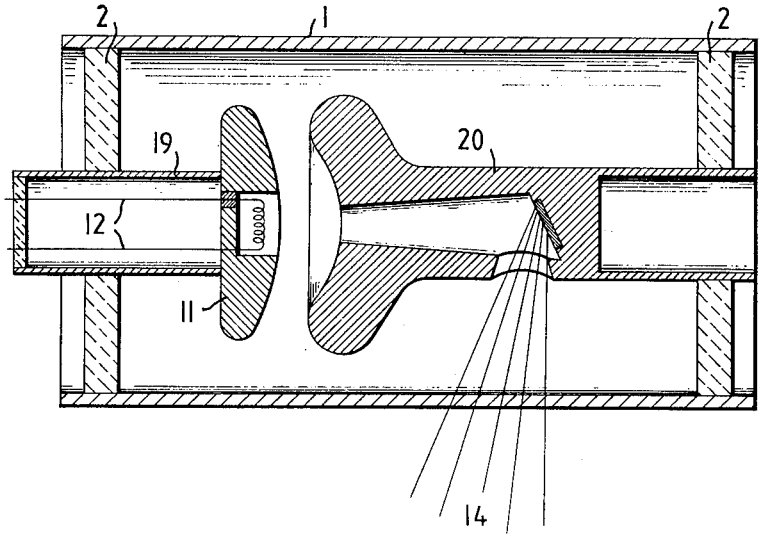
FIG. 3 is a schematic sectional view showing another embodiment of the present invention.
Figure 4:
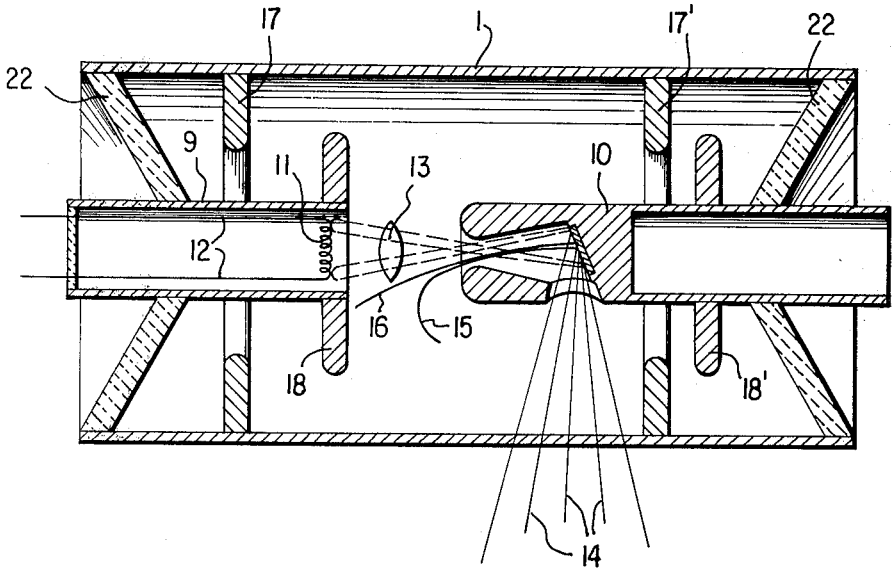
FIG. 4 is a schematic sectional view showing still another embodiment of the invention.

Referring to FIG. 1, which shows a prior art X-ray apparatus as disclosed at FIG. 4 of the aforementioned U.S. Pat. No. 4,126,803, there is shown an apparatus comprising a vacuum envelope formed of a grounded metal cylindrical wall or jacket member 1 and a pair of annular ceramic insulating discs 2 disposed at the ends of the cylindrical member 1 to form the respective end or frontal surfaces of the envelope. The annular ceramic discs 2 are connected to the cylindrical metal wall or jacket member 1 in a vacuum-tight manner and are provided with central apertures through which high voltage leads 3 and 3' pass in a vacuum-tight manner for connection to the cathode K and anode A respectively. The outer frontal surfaces of the ceramic discs 2 can be in a plane perpendicular to the longitudinal axis of the wall member 1, as shown in FIG. 1, or may be at an angle equal to or less than 45° to this plane (preferably less than 30°) as illustrated in FIGS. 2, 3, 10 and 11 of U.S. Pat. No. 4,126,803.

Connecting members 4 are axially pressed onto the leads 3, 3' and the ceramic members 2. Each of the connecting members 4 has a metal outer jacket 6 as well as coupling parts 5 into which high voltage plugs can be inserted. The connecting members 4 are filled with a liquid or gaseous insulating medium 7 which, since the ends of the jackets 6 adjacent the discs 2 are open, also wets the outer surfaces of the ceramic discs. Sealing rings 8 are provided to assure that the insulating medium 7 cannot escape from connecting members 4. The metal jacket 6 is electrically connected with vacuum envelope jacket 1 of the X-ray tube and is also connected to ground.

As explained in U.S. Pat. No. 4,126,803, the sides or surfaces of the connecting member adjacent the outer frontal surface of the annular ceramic discs 2 may either be open or closed. If the surface of the connecting members adjacent the surface of the associated ceramic disc, i.e., the mating or connecting surface, is open, the open frontal face of the connecting part is sealed in a gas or liquid-tight manner to the frontal surface of the ceramic disc 2 or to the metal jacket member 1 and then the interior of the connecting member is filled with an insulating gas or oil. The connecting members may contain couplings or possibly transformers or directly contain the high voltage cables.

Figure 2:
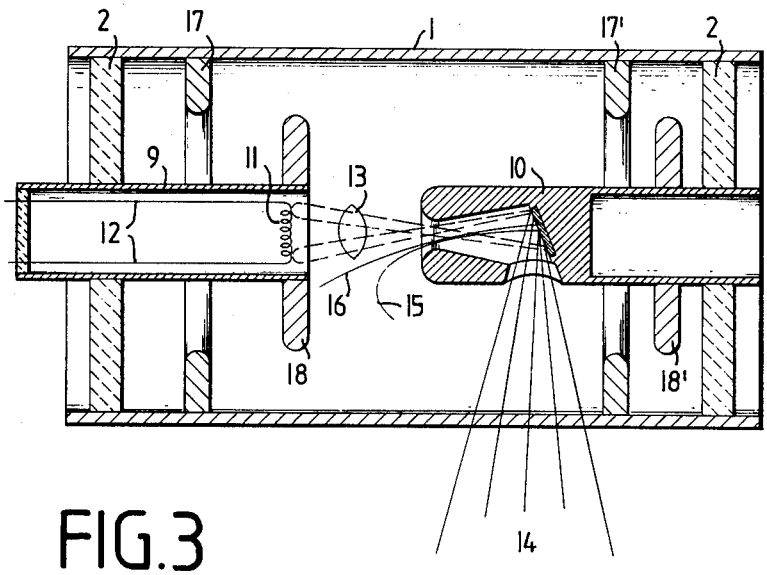
FIG. 2 is a schematic sectional view showing one embodiment of the present invention.

FIG. 2 is a sectional schematic view of the present invention in which like parts are designated by the same numerals as in the prior art apparatus of FIG. 1. The connecting members 4 have been omitted from the drawing to permit the depicted portions of the invention to be shown on an enlarged scale but it will be understood that connecting members 4 constitute a part of the apparatus of FIG. 2. The depicted part of the X-ray tube comprises a cylindrical metal portion 1 closed in a vacuum-tight manner at its frontal face by annular ceramic members 2. These ceramic members 2 are provided with openings in their centers into which the high voltage leads, the cathode 9 and the anode 10 are inserted in a vacuum-tight manner. Such an arrangement is called a dual-pole X-ray tube.

In the operating state of the apparatus, a glow cathode 11 disposed in the cathode electrode 9 is supplied with current via leads 12 and is heated by the passage of current so that electrons are discharged which, formed into a beam 13, impinge on the anode 10. X-rays 14 are thus produced in a known manner.

In addition to the desired generation of X-rays other processes take place in such a device, such as, for example, field emission, emission of secondary electrons and the photoeffect, which may impede the reliable operation of such an apparatus.

A particularly disadvantageous effect is the emission of secondary electrons. When the electron beam 13 impinges on the anode 10, there are produced, in addition to the desired X-rays 14, undesired secondary electrons which propagate in the interior of the X-ray tube, approximately on the paths marked 15 and 16. Particularly in X-ray tubes having a very short structural length, there is a high probability that these secondary electrons will impinge on the ceramic members 2 forming the frontal terminations of the X-ray tube. As a result, the high voltage stability of such a device is reduced in an undesirable manner.

The present invention prevents this disadvantageous phenomenon in that at least one shielding electrode is disposed in the interior of the X-ray tube so as to prevent impingement of charged particles, particularly the secondary electrons, on insulated portions thereof, particularly the annular ceramic members 2.

At least one pair of shielding electrodes is provided which, with the rotationally symmetrical design of the X-ray tube, are preferably arranged coaxially and spaced from one another so that they prevent propagation of charged particles to the insulating members of the X-ray tube. Rotationally symmetrically designed shielding electrodes which have, for example, the shape of a circular ring can be easily produced.

Referring to FIG. 2, a first pair of shielding electrodes 17, 18 surrounds the cathode electrode 9 and a second pair of shielding electrodes 17', 18' surround the anode electrode 10 within the metal cylindrical wall 1 of the X-ray apparatus. Each of the shielding electrodes 17 and 17' has an outer diameter such that its outer edge abuts and is electrically connected to the cylindrical metal part 1. Each of the shielding electrodes 18 and 18' has an outer diameter which is smaller than that of electrodes 17 and 17', electrodes 18 and 18' being coaxially spaced from electrodes 17 and 17' respectively and being seated on the cathode 9 and anode 10 respectively. The spacing between the first pair of electrodes 17 and 18 and between the second pair of electrodes 17' and 18' is selected such that the shielding electrodes 17, 18 and 17', 18' shield the ceramic members 2 from interfering secondary electrons.

It has been found that a particularly good shielding effect and, therefore, correspondingly improved high voltage stability can be obtained if the shielding electrodes 18, 18' having the smaller outer diameter and which are seated directly on the cathode electrode 9 and anode 10 respectively, are disposed closer to the anode end of the X-ray tube than the corresponding shielding electrode 17, 17' having the larger outer diameter and which are connected to the metal portion 1 of the tube. Preferably the shielding electrodes 17, 18 and 17', 18' are made of a material that is an excellent electrical conductor because this prevents undesirable charging of the shielding electrodes. Suitable electrode materials are, for example, stainless steel and Fe-Ni-Co alloy. In a typical apparatus of the type shown in FIG. 2, the diameter and length of the cylindrical member are 150 mm and 270 mm, the spacing between shielding member 17 and 18 is 15 mm and the spacing between shielding members 17' and 18' is 15 mm.

Two conditions must be met simultaneously in dimensioning the shielding electrodes:

(a) No charged particles coming from the area between the oppositely disposed anode and cathode electrodes must impinge on the insulating member to be protected. That is, all possible paths of electrons starting somewhere between the electrodes must end at the shielding members. In particular, the paths of electrons having a high starting energy must end on the shielding members. Generally, this condition is met when the surface of the insulating member to be protected cannot be seen from any point between the electrodes and in the interior of the vacuum chamber of the tube, i.e., the shielding is "optically tight."

(b) The surfaces of the shielding electrodes must not be electrically stressed to excess. That is, during operation of the device at its rated voltage, the maximum field intensities for the materials involved must not be exceeded at their surfaces.

When "optical tightness" has been achieved, this requirement makes it particularly important that the shielding effect be achieved at the shielding electrodes for any desired interior, exterior and curvature diameters. It has been found that optimum operation occurs only for a precisely defined triplet of numbers for the inner diameter of the external shielding member, for the outer diameter of the internal shielding member and for the radii of curvature at the free ends of the shielding electrodes. For example, for a tube designed for $2\times210$ kV direct voltage, the radius of curvature at the two shielding members is identical and has a radius of 1 cm, the inner diameter of the external shielding member is 7.7 cm and the outer diameter of the internal shielding member is 11.5 cm.

FIG. 3 shows a modification of the invention in which the high voltage cathode and anode electrodes of the X-ray tube are given such a shape that they are simultaneously effective as shielding electrodes for the ceramic member 2. For this purpose the facing end pieces of the cathode 19 and the anode 20 whose diameter is determined by the requirements for field intensity, beam formation and heat dissipation are increased by a factor of more than 1.5 so that they can also perform the functions of electrodes 18 and 18' (FIG. 2). Namely, shielding the insulators against impingement of charged particles. Secondary electrons are prevented from reaching the ceramic members 2 by the end pieces of the cathode 19 and anode 20 which are arranged in as close proximity as possible to one another and have been given the above-described shape.

This modification results from calculations of field distribution and electron paths by simulating various electrode shapes. The calculations provide one shape for which all field intensities lie below the permissible limit and all possible electron paths end on the shielding members.

FIG. 4 is a modification of the x-ray apparatus of FIG. 2 wherein like parts are designated by the same numbers. The apparatus of FIG. 4 differs from that of FIG. 2 in that the annular ceramic members 22 form an angle not greater than 45° with a plane perpendicular to the longitudinal axis of the metal cylindrical wall member 1. In addition, electrodes 18 and 18' are shown as having outer diameters which are greater than the inner diameters of the electrodes 17 and 17', respectively.

It will be understood that the above description of the present invention is susceptible to various modifications, changes and adaptations, and the same are intended to be comprehended within the meaning and range of equivalents of the appended claims.

What is claimed is:

1. X-ray apparatus comprising a metal cylindrical wall member having a longitudinal axis and opposite first and second open ends;

a pair of end members positioned within the open ends of said wall member, at least one of said end members being an annular ceramic member having a central aperture therein and being sealed at its outer periphery to said wall member;

anode and cathode elements located within said wall member, said anode and cathode elements being located respectively at the first and second ends of said wall member and being shaped such that they shield said annular ceramic member thereby preventing impingement of charged particles thereon;

a pair of high voltage leads connected to said anode and cathode elements respectively, at least one of said high voltage leads passing through the aperture in said ceramic member in a vacuum-tight manner to form a vacuum-tight envelope comprising said wall and end members;

at least one connecting member releasably attached to an end of said wall member adjacent said annular ceramic member for providing an axial releasable electrical connection with said at least one high voltage lead, the outer face of said annular ceramic member being rotationally symmetrical with respect to the longitudinal axis of said wall member and forming an angle not greater than 45° with a plane perpendicular to said longitudinal axis; and first and second axially spaced conductive shielding electrodes surrounding at least one of said anode and cathode elements and being rotationally symmetrical with respect to the longitudinal axis of said wall member, said first electrode having a greater outer diameter than said second electrode and being electrically connected to said wall member, said second electrode being electrically connected to the element surrounded by said electrodes, said first electrode having an inner diameter which is less than the outer diameter of said second electrode, and said second electrode being closer to the first end of said wall member than said first electrode.

2. X-ray apparatus comprising a metal cylindrical wall member having a longitudinal axis and opposite first and second open ends;

a pair of end members positioned within the open ends of said wall member, at least one of said end members being an annular ceramic member having a central aperture therein and being sealed at its outer periphery to said wall member;

anode and cathode elements located within said wall member, said anode and cathode elements being located respectively at the first and second ends of said wall member;

a pair of high voltage leads connected to said anode and cathode elements respectively, at least one of said high voltage leads passing through the aperture in said ceramic member in a vacuum-tight manner to form a vacuum-tight envelope comprising said wall and end members;

at least one connecting member releasably attached to an end of said wall member adjacent said annular ceramic member for providing an axial releasable electrical connection with said at least one high voltage lead; the outer face of said annular ceramic member being rotationally symmetrical with respect to the longitudinal axis of said wall member and forming an angle not greater than 45° with a plane perpendicular to said longitudinal axis; and first and second axially spaced conductive shielding electrodes surrounding at least one of said anode and cathode elements and being rotationally symmetrical with respect to the longitudinal axis of said wall member, said first electrode having a greater outer diameter than said second electrode and being electrically connected to said wall member, said second electrode being electrically connected to the element surrounded by said electrodes, said first electrode having an inner diameter which is less than the outer diameter of said second electrode, and said second electrode being closer to the first end of said wall member than said first electrode.

3. X-ray apparatus as defined in claim 1 or 2 wherein said shielding electrodes have the shape of a ring.

4. X-ray apparatus as defined in claim 1 or 2 wherein said shielding electrode is made of a material having high electrical conductivity.

5. X-ray apparatus as defined in claim 4 wherein said shielding electrode is made of a material selected from the group consisting of stainless steel and an iron-nickel-cobalt alloy.

* * * * *